United States Patent [19]

Kobler et al.

[11] Patent Number: 5,031,891

[45] Date of Patent: Jul. 16, 1991

[54] METHOD AND SYSTEM FOR SELECTIVELY COLLATING SUBJECTIVELY DIFFERENT PRINTED COPY PRODUCTS, PARTICULARLY DIFFERENT NEWSPAPER INSERTS FOR TARGETED DISTRIBUTION

[75] Inventors: Ingo Kobler, Anhausen; Godber Petersen, Augsburg, both of Fed. Rep. of Germany

[73] Assignee: MAN Roland Druckmaschinen AG, Offenbach am Main, Fed. Rep. of Germany

[21] Appl. No.: 536,076

[22] Filed: Jun. 11, 1990

Related U.S. Application Data

[63] Continuation of Ser. No. 307,333, Feb. 6, 1989, abandoned.

[30] Foreign Application Priority Data

Feb. 27, 1988 [DE] Fed. Rep. of Germany ..... 3806351

[51] Int. Cl.[5] ..... B65H 39/02

[52] U.S. Cl. ..... 270/54; 270/58

[58] Field of Search ..... 270/52, 54–58; 364/478

[56] References Cited

U.S. PATENT DOCUMENTS

| | | | |
|---|---|---|---|
| 3,442,186 | 5/1969 | Hirose et al. . | |
| 3,819,173 | 6/1974 | Anderson | 270/54 |
| 3,917,252 | 11/1975 | Harder et al. | 270/58 |
| 4,022,455 | 5/1977 | Newsome | 270/54 |
| 4,484,733 | 11/1984 | Loos | 270/58 |
| 4,500,083 | 2/1985 | Wong | 270/54 |

FOREIGN PATENT DOCUMENTS

| | | | |
|---|---|---|---|
| 967668 | 5/1975 | Canada | 270/54 |
| 2726131 | 12/1978 | Fed. Rep. of Germany . | |
| 570326 | 12/1975 | Switzerland . | |

*Primary Examiner*—Edward K. Look
*Assistant Examiner*—Therese M. Newholm
*Attorney, Agent, or Firm*—Frishauf, Holtz, Goodman & Woodward

[57] ABSTRACT

To permit placement of selected copy products having different subject matter together in specifically collated copy product assemblies, for association of individualized copy product assemblies with delivery addresses in a specific sequence, for example specific to subscribers or distribution stations or regions, a controller-computer (10) stores delivery addresses and the desired copy products at specific delivery addresses. All the copy products are stored in individual storage locations, from which, with respect to a specific address within the sequence, selected individual copy products are removed, for placement on collecting spaces (48–56) on a collecting transport system. The controller-computer includes timing circuits controlling, respectively, the removal and guidance of selected copy products for the specific addresses in the sequence to specific collecting spaces, as the transport system moves beneath the storage locations or stations, to form the collected product assemblies which, then, can be supplied with a cover (39) or directly with the delivery address. The first or last of the copy product stations (1, 4) can hold folded newspapers which, for example, can be the main section of a newspaper, with which specific regional or advertisement inserts, formed by the copy products, are then assembled.

15 Claims, 1 Drawing Sheet

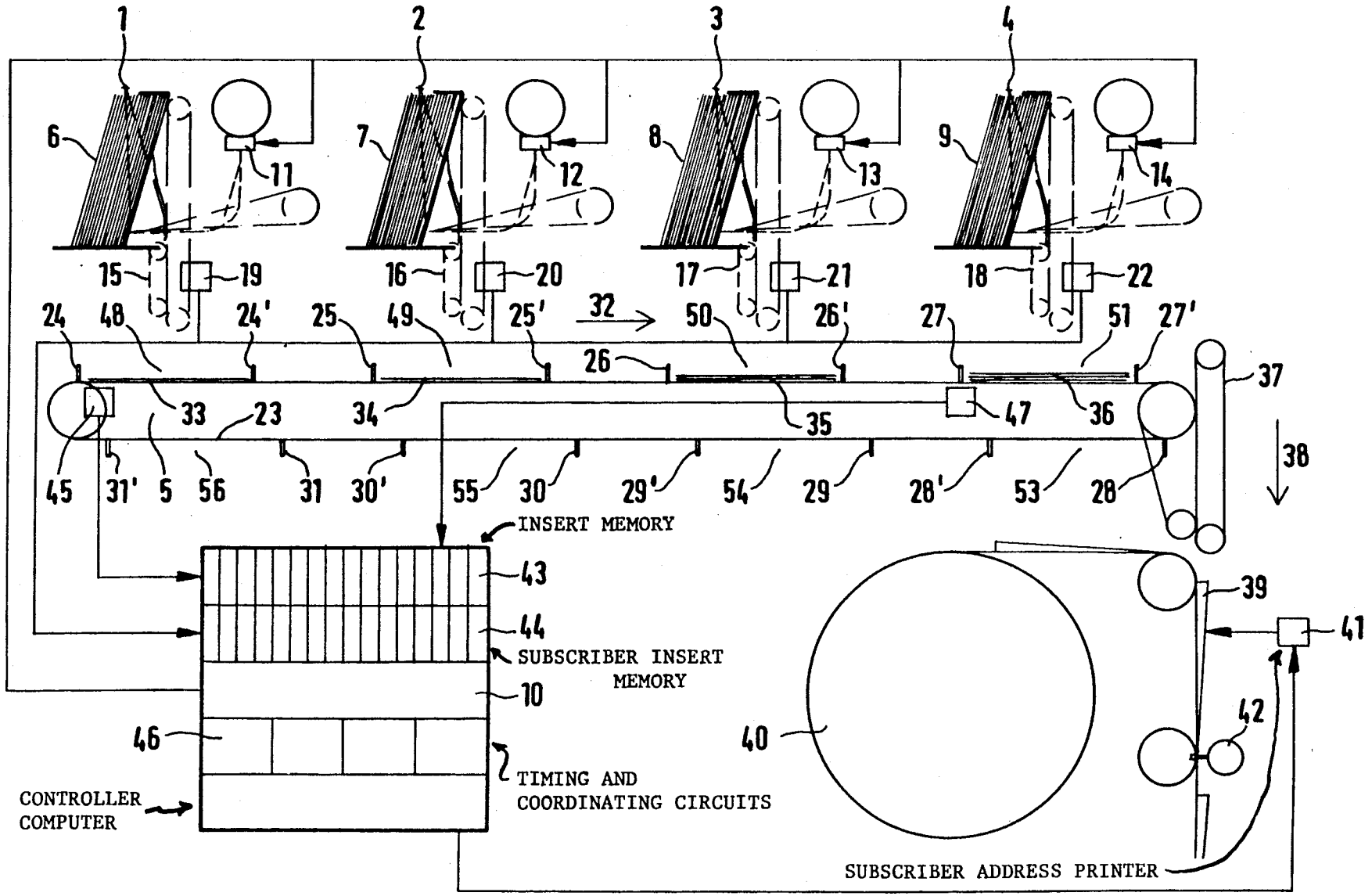
SUBSCRIBER ADDRESS PRINTER
INSERT MEMORY
SUBSCRIBER INSERT MEMORY
TIMING AND COORDINATING CIRCUITS
CONTROLLER COMPUTER

METHOD AND SYSTEM FOR SELECTIVELY COLLATING SUBJECTIVELY DIFFERENT PRINTED COPY PRODUCTS, PARTICULARLY DIFFERENT NEWSPAPER INSERTS FOR TARGETED DISTRIBUTION

This application is a continuation of U.S. application Ser. No. 07/307,333, filed Feb. 6, 1989, now abandoned.

Reference to related applications assigned to the assignee of the present invention, the disclosures of which are hereby incorporated by reference:

U.S. Ser. No. 07/303,411, filed Feb. 8, 1989, Petersen; and U.S. Ser. No. 07/330,340, filed Jan. 23, 1989, Petersen The present invention relates to a method and a system to collate printed copy products having different subject matter, for example newspaper inserts to be placed in newspapers or newspaper sections, for targeted distribution, or for specific distribution to specific subscribers desiring specific information inserts.

Background. Various types of apparatus are known in order to associate printed copy products forming inserts and additions to newspapers, for example to associate various local sections to a national section, to add specific advertisement inserts targeted to particular readers or to particular geographic locations. Such addition or insertion can be done by machinery and/or partially or entirely manually. Printed copy products are then delivered over distribution systems to the receivers which, for example, may be individual subscribers, or specific distribution sections or newsstands located, for example, in a specific geographic area. Individualizing the assembled copy products was not economically possible heretofore, particularly if a substantial number of different copy products are available, for individual association with, for example, a main or national section. To associate specific ones of a large number of copy products was expensive and difficult and, therefore, usually not economically feasible.

If two different copy products are to be associated with, for example, a main newspaper, four possibilities arise; if four different inserts or section copy products are available, sixteen possibilities for individual association are possible. The possibilities of combination rise exponentially as the number of subjectively different copy products increases. This was one of the reasons why individually associated collection of copy products heretofore was not readily possible, for example in order to provide individual subscribers with newspapers which include just those sections or inserts which the subscriber may wish, associated with a general news section.

The Invention. It is an object to provide a method and a system to associate subjectively different copy products so that an associated collated copy product assembly is obtained which is individualized for a subscriber, to provide the subscriber his own "individually selected" newspaper; and to provide newspapers with individually selected copy products or sections, for specific regional distribution or in specific sequences of addresses of the intended recipient;

Briefly, a controller - computer apparatus is provided which stores (a) delivery addresses of all the subcribers and (b) the desired copy products, inserts or sections.

A moving collating transport system having a plurality of identifying collating spaces is provided, for example in form of a belt which has division sections for a group of copy products on which the specifically desired copy products can be assembled. The individual copy products themselves are stored at individual storage locations. Removal of individual copy products is selectively individually controlled by the controller - computer, to place on any one of the collecting spaces of the transport systems just those copy products which are desired by a particular subscriber, the specific copy products being guided selectively individually on the identified individual collection spaces on the transport system. Thus, each one of the individual collecting spaces on the transport system will have only those copy products desired by a specific subscriber thereon. As the transport system moves, the delivery address of the subscriber is applied to the collated copy product assembly in the particular identified space, for example by applying a label or printing on a wrapper, which wrapper may, for example, be the daily general edition of the newspaper itself into which the collated copy product assemblies are then placed or inserted. The sequence of copy product distribution delivery addresses is obtained from the delivery addresses of the subscribers. The time of removal of the copy products from the individual storage locations, and the application of the specific address, is controlled by the controller-computer which receives data of the travel distance or travel speed of the transport system and any associated apparatus receiving the collated copy products, for example a plastic foil envelope forming cutting and sealing apparatus or the like.

As used hereinabove and in the application that follows, the term "subscriber" has been selected to denote not only an individual subscriber but, also, a newsstand or distribution region which subscribes to receive groups of or bundled newspapers with specifically designated sections or inserts.

DRAWING:

The single FIGURE is a highly schematic representation of the system of the present invention which carries out the method thereof.

Detailed Description

Storage locations 1, 2, 3, 4, so arranged that individual copy products 6, 7, 8, 9 stored thereon can be remove from the storage locations store the respective copy products which carry different subject matter, for example different types of advertisement, different regional news, different information sections or the like. A moving collecting transport system 5 is located preferably beneath the stations 1–4. The transport system 5 may include well known endless belt transports or chain transport apparatus, customarily used in paper handling or newspaper distribution apparatus. The subjectively different products held separately at the at the stations 1–4 are assembled or associated together to form associated collated copy product assemblies 36, in accordance with specific product selection control based on the delivery address sequence. The data or information regarding the selection is stored in a memory section of a controller-computer 10. The memory, of course, may be separate from the computer or integrated therein; the computer stores (a) the delivery addresses of the subscribers to the newspaper, that is, the intended recipients of the copy products; and (b) the desired subject matter of the copy products of each of the subscribers. Suitable codes, of course, may be used, as well known in encoding of addresses and subject matter information.

The sequence of copy product distribution delivery addresses is obtained from the delivery addresses of the subscribers which, of course, may also be distribution outlets and/or distributes selected, for example, from the publishers of the newspaper, who are to receive specifically targeted copy products or copy product assemblies. Usually, the subscribers are newspaper subscribers whose name and address is known. For specific regions, for example, a sequence of street addresses, postal codes or zones or the like, a copy product distribution address sequence can be provided. The specific desires of the subscribers are also known, for example obtained by a survey, so that the controller-computer 10 can readily provide a stored code which defines for each one of the subscribers the specific copy products which the subscriber wishes to receive. Usually, there will be a plurality of such collated copy products to form the assemblies, although in selected instances, the "assembly" may be only a single insert or copy product.

The copy products 6 to 9 may be one part of the newspaper itself. For example, and preferably either the first or the last of the products, that is, the products 6 or 9, may be the main section of a newspaper, the remaining copy products 7 to 9 or 6 to 8 being the desired inserts or subjectively different copy products. It is, of course, equally possible to store subjectively different copy products which all will form inserts or special sections and adding, for example at the left of the collating transport system 5 - with respect to the FIGURE - the daily main section of a newspaper, derived, for example, directly from the daily newspaper printing machine, or a folding apparatus or other associated apparatus for application of the subjectively different copy products 6 to 9 therewith.

The stations 1–4 for the printed products include removal apparatus which, in a well known and simple form, includes - selectively operable valves 11–14 and belt systems 15–18. A transfer arm, not specifically shown and well known in removing inserts or sections from a stack and having suction cups thereon, is selectively operated and the suction cups supplied with suction from the respective valves 11–14 to remove the rearmost one of the copy products on the stations 1–4 and transfer it to the local belt transport system 15–18. To ensure reliability, a monitoring gate 19–22 is associated with each of the belts 15–18, to determine that the copy product which has been selected by the controller-computer 10 is actually fed from the selected station by the respective local belt system 15–8.

The collating transport system 5 includes a continuously movable endless belt or chain which has transversely extending projections or rails 24, 25 . . . . 31 thereon to form therebetween collecting spaces 48–56. The collecting spaces 48–56 collect the selected copy products and generate the copy product assembly 36. Subassemblies, which may include only one copy product, for example, are formed along the line of travel of the belt system 5, as shown schematically at 33, 34, 35. The projections, rails, or other elements which define the respective collection spaces 48–56 carry codes 24'. . . 31' applied, for example, to an upstanding ridge, and readable by suitable code readers. The codes define addresses of the specific collection spaces on the transport system 5.

In dependence on control of the valves and removal arrangement on the respective storage locations or stations 1, 2, 3, 4, it is possible to place in each one of the collecting spaces 48–56 any combination of copy products 6, 7, 8, 9, in which, for example, the copy products at one of the stations, preferably the first or the last, form, for example, the main section of the daily newspaper. The assemblies are enclosed in a cover which may be the daily section of the newspaper or an outer one of the sheets of the copy products. The cover, which may include the daily section, may be ahead or behind the transport system 5 - in direction of movement. The upper run of the belts of the transport system 5, in the example selected, move from left to right, with respect to the figure. Alternatively, and as shown, an additional cover in the form of a foil pocket, may be used on which the address is then applied.

Referring again to the drawing, a subsidiary transport belt 37 is located at the end of the collecting transport system 5, by means of which the collated copy product assemblies 36 are fed in the direction of the arrow 38 into a foil cover, for example a pocket formed of plastic foil, and supplied from a pocket supply roll 40. Such plastic foils, preformed for example with pockets or forming the pockets around the copy products, do not form part of the present invention and, by themselves, are well known. After placement of the copy product assemblies into a foil pocket, they are directly guided to a cutter and seam welding apparatus including, for example, a pair of rollers which sever the continuous foil while welding the severed edge shut. An address application apparatus 41, for example a subscriber address printer, which may include a label applier, applies the subscriber's mailing or distribution or route address to the cover, for example to the foil.

The controller-computer, shown only schematically, has inherently or coupled thereto, memories 43, 44. The controller-computer additionally has a group of timing and coordinating circuits 46. Preferably, the number of timing and coordinating circuits corresponds at least to the number of collecting spaces 48–51 which, at any time, are beneath the storage locations or stations 1–4.

A transducer or sensor 45 located at the initial portion of the collating transport system 5 provides information to the computer when a collecting space passes the sensor; preferably, the sensor can, at the same time, read a code 24'–31' which identifies the specific collection spaces. The computer, then, readily and by means of the stored printed product distribution addresses, and the code stored which defines which ones of the printed products are to be applied to any one address, can control the respective valves 11-14 to place in any one predetermined collection space 48-51 the desired individual inserts or copy products to form the final product assembly 36 for any specified address.

A second transducer 47 is located along the path of the transport system 5. The transducer or sensor 47, preferably, also is capable of reading the codes 24'. . . 31' on the collating transport system and communicate the information when the last copy product 9 from the last storage location 4 has been placed and the collated copy product assembly 36 leaves the collating transport system 5. The timing and coordinating circuits can also determine the instant of time when the respective valves 11 to 14 are to be controlled in order to insert a desired copy product on a specific collecting space, or to remain inoperative because a specific copy product is not to be placed in a collecting space because not desired by a specific subscriber. The timing circuits also determine at which time a predetermined, that is already assembled copy product assembly 36 reaches the region in front of the subscriber address printer 41, for example when a copy product assembly is inserted into a foil pocket 39, at which time the address can be applied at which the specific copy product assembly is to be delivered. Of course, it is not necessary that a foil pocket be used, the copy product itself can have the delivery address applied, for example if no covering by foil is desired.

The application of the subscriber address need not follow immediately the delivery of the copy product from the collating transport system 5, since the timing and coordinating circuits can introduce longer time delays. Storage structures, which are described in the referenced applications:

U.S. Ser. No. 07/308,411, filed Feb. 8, 1989, Petersen and U.S. Ser. No. 07/300,340, filed Jan. 28, 1989, Petersen can be used. These accordion-like storage structures permit placement of a substantial number of individualized collated copy product assemblies into a folded previously stored copy product, which folded product is an open V-condition, for subsequent addressing of the product in the storage structure. This may, for example, be the cover or main section of a newspaper which has the individual subscriber's address applied, and the specifically collated copy product assemblies 36, derived from the transport system 5, inserted therein. Thus, the newspaper will form the cover, subsequently addressed under control of the controller-computer 10 and timed by the timing and coordinating circuits 46.

A suitable controller-computer 10 to carry out the control tasks is: a Hewlett Packard HP 1000 (as a supervisory Computer) connected to a Siemens SA 5 (freely programmable control unit with multiple output port)

The various components of the system, for example the suction valves 11, the storage locations or sections 1–4, the address printer and the like, are all commercial articles, and readily controllable for selective operation by a suitable controller-computer. Associating specific data with specific addresses is routine programming, for example similar to the well known "mail merge" programs.

We claim:

1. A method of selectively collating subjectively different printed copy products (6–9) individually selected for subscribers, particularly different inserts for printed publications, comprising the steps of storing, in a controller-computer (10)

(a) the subject matter of copy products selected for subscribers having delivery addresses to which said copy products are to be delivered; and (b) the delivery addresses of the subscribers of the copy products in a predetermined sequence, wherein said sequence consists of a predetermined sequence of delivery;

providing a moving collating transport system (5) having a plurality of identifiable individual collecting spaces (48–56);

separately storing the copy products (6–9) at individual storage locations (1–4);

selectively individually controlling removal of copy products from the storage locations (1–4) based on (a) the desired subject matter of the respectively stored copy products, and (b) the delivery address in said predetermined sequence of the delivery addresses for subsequent distribution of the copy products to said addresses;

guiding selectively individually removed copy products to identified individual collecting spaces (48–56) of the collecting transport system (5) to form individually associated collated copy product assemblies (36) at the identified individual collecting space;

selectively applying (41) a respective delivery address to the collated copy product assembly (36) under control of the controller computer (10) in accordance with the stored delivery address while retaining said sequence of the delivery addresses; and controlling the respective time of removal and guidance step and the address application step under control of the controller-computer (10).

2. The method of claim 1, including the step of sensing (45, 47) movement of the collating transport system (5) and delivering timing data representative of the passage of an individual collecting space past a reference position; and communicating said timing data to the controller-computer (10).

3. The method of claim 1, further including the step of placing the collated copy products within a cover; and wherein said address application step includes applying a delivery address to the cover for the copy product.

4. The method of claim 1, further including the step of providing a cover foil supply forming foil pockets;

introducing the collated copy products within the foil pockets; and wherein the address application step includes applying the delivery address to the foil pockets.

5. The method of claim 1, further including the steps of providing said collating transport system with data or code carriers (24'–31') operatively associated with individual collecting spaces and having codes or data information applied thereto specific to the individual collecting spaces; and the step of reading data or codes from said code carriers, associated with specific collecting spaces on the transport system and communicating the thus obtained information tot he controller-computer (10).

6. A system for selectively collating subjectively different printed copy products (6–9) individually selected for subscribers, particularly different inserts for printed publications, comprising a controller-computer (16) including memory means (43, 44) for storing (a) the subject matter of copy products selected for subscribers having delivery addresses to which said copy products are to be delivered; and (b) the delivery addresses of the subscribers of the copy products in a predetermined sequence;

wherein said sequence consists of a predetermined sequence of delivery;

a moving collating transport system (5) defining a plurality of identifiable individual collecting spaces (48–56);

a plurality of individual storage locations or sections (4) for separately storing groups of copy products (6, 9), wherein the copy products of each group carry different subject matter;

means (11–14; 15–18; 19–22) for selectively individually controlling removal of the copy products from the storage locations based on (a) the desired subject matter carried by any copy product, and (b) the delivery address of the copy product in said predetermined sequence of the delivery address for subsequent distribution of the copy products to said addresses, and for guiding said selectively individually removed copy products on identifiable individual collecting spaces of the collating transport system (5), to form, in said collecting spaces, individually associated collated copy product assemblies (36) in said predetermined sequence;

means (41) for selectively applying a delivery address to the collated copy product assemblies (36);

means for connecting said controller-computer (10) to said removal and guidance means, and to said address application means for controlling (a) the nature or characteristics of the copy product assemblies based on the selected removed copy products, and (b) while retaining said sequence of the delivery addresses, guiding said removed copy products in individual collecting spaces (48–56) for placement of the resulting collated copy product assemblies (36) in said individual collecting spaces in said sequence; and means for applying the desired copy product address to said selected copy product.

7. The system of claim 6, wherein said controllercomputer (10) includes timing and coordinating circuits (46), said timing and coordinating circuits being controlled as a function of movement of said collecting transport system (5).

8. The system of claim 6, wherein said collating transport system (5) defines an elongated transport path positioned to receive the printed copy products from said storage locations; and wherein adjacent at least one extreme end of the path of said collating transport system (5) a transducer is provided responsive to sense the presence of an individual collecting space passing said transducer, said transducer being connected to said controller-computer (!0) for controlling the timing by said computer of, respectively, said removal means and said addressing means (41).

9. The system of claim 8, wherein two transducers or sensors (45, 47) are provided, one each located adjacent an extreme end of the collating transport system (5), each transducer being connected to and providing data to said controller-computer (10).

10. The system of claim 6, further including foil supply means (40) supplying foil covers for said collated product assemblies (36), and means (37) for transferring said collated copy product assemblies (36) from said collating transport system (5) for coverage by said foil covers.

11. The system of claim 6, wherein at least one (6, 9) of said copy products is a folded newspaper section.

12. The system of claim 11, wherein said collating transport system (5) defines a start and end location, and said copy forming the folded newspaper section is located at an extreme position (1, 5) of the collating transport system.

13. The system of claim 6, wherein the transport system (5) includes an endless belt or chain system;

a removal belt arrangement (37) is located at the end of the collecting transport system at which the collated copy product assemblies (36) are delivered;

and further comprising a foil wrap or pocketing apparatus (39) positioned downstream of said removal belt arrangement to receive the associated collated copy product assemblies (36) therefrom.

14. The system of claim 6, further including projecting elements on said collating transport system (5) and defining, at least in part, said collecting spaces (48–56), data and codes defining said collecting spaces being applied to said projecting elements;

and wherein data or code readers (45, 47) are provided located along the collating transport system (5) and communicating to said controller-computer (10), the data or codes read-out from said projecting elements and the time when the specific data and codes being read-out pass said readers.

15. The system of claim 6, further including a foil supply roller (40) supplying foil pockets (39) and placing said foil pockets in the path of the collated copy product assemblies, for placement of the collated copy product assemblies in said foil pockets;

and cutter and sealing means for cutting the foil pockets and sealing the foil pockets with the collated copy product assemblies therein.

* * * * *